US005488784A

United States Patent [19]

Woodmansee et al.

[11] Patent Number: 5,488,784

[45] Date of Patent: Feb. 6, 1996

[54] VENTILATED TRAY FOR ADSORBENT DESORPTION

[75] Inventors: Donald E. Woodmansee; Andrew P. Shapiro, both of Schenectady, N.Y.

[73] Assignee: General Electric Company, Schenectady, N.Y.

[21] Appl. No.: 21,938

[22] Filed: Feb. 24, 1993

[51] Int. Cl.[6] ..... F26B 11/18

[52] U.S. Cl. ..... 34/193; 34/80; 34/259

[58] Field of Search ..... 34/192, 193, 194, 34/195, 57 A, 57 R, 259, 263, 264, 265

[56] References Cited

U.S. PATENT DOCUMENTS

| | | | |
|---|---|---|---|
| 8,398 | 9/1858 | Lippy et al. | 34/193 |
| 52,524 | 2/1866 | Bulkley | 34/81 |
| 205,606 | 7/1878 | De Bevoise | 34/81 X |
| 233,643 | 10/1880 | Teasdale | 34/200 |
| 2,376,095 | 5/1945 | Shoeld | 34/80 X |
| 3,982,900 | 9/1976 | Malgarini et al. | 34/57 A X |
| 4,107,851 | 8/1978 | Takacs | 34/57 A |
| 4,199,873 | 4/1980 | Hansen et al. | 34/91 |
| 4,322,394 | 3/1982 | Mezey et al. | 423/244 |
| 4,370,534 | 1/1983 | Brandon | 219/10.55 A |
| 4,444,723 | 4/1984 | Matsumaru et al. | 422/159 |
| 4,600,380 | 7/1986 | Von Wedel | 34/57 A |
| 4,711,039 | 12/1987 | Napier et al. | 34/57 A |
| 4,737,610 | 4/1988 | Kotsch et al. | 219/10.55 M |
| 4,746,968 | 5/1988 | Wear et al. | 219/10.55 F |
| 5,079,396 | 1/1992 | Katz et al. | 219/10.55 E |
| 5,200,146 | 4/1993 | Goodman | 422/23 |

FOREIGN PATENT DOCUMENTS

| | | | |
|---|---|---|---|
| 61-26992 | 11/1986 | Japan | 34/259 |
| 2230968 | 11/1990 | United Kingdom | 34/259 |

*Primary Examiner*—Henry A. Bennett
*Attorney, Agent, or Firm*—Paul R. Webb, II

[57] ABSTRACT

A ventilated tray for holding adsorbent material during microwave desorption of the material. The tray facilitates the flow of desorption gases through a bed of adsorbent without agitation of the adsorbent. The ventilated tray includes a housing having four walls and a bottom piece and a gas-permeable adsorbent support structure disposed in the housing. The adsorbent support structure is positioned above the bottom piece so that the adsorbent support structure, the bottom piece and the four walls define a plenum. A gas passage aperture is located in one of the housing walls to providing fluid communication between the plenum and the exterior of the housing. The adsorbent support structure is a porous plate having pores which are smaller than the grain size of the adsorbent material. Alternatively, the adsorbent support structure can be a two-tiered structure which relies on the adsorbent's angle of repose to support the adsorbent. A second embodiment of the ventilated tray includes a housing having four walls and a gas-permeable bottom piece which supports the adsorbent bed.

8 Claims, 4 Drawing Sheets

VENTILATED TRAY FOR ADSORBENT DESORPTION

CROSS REFERENCE TO RELATED APPLICATIONS

This application is related to copending application entitled "Batch System for Microwave Desorption of Adsorbents," Ser. No. 08/021,937, filed concurrently herewith and assigned to the same assignee as the present invention.

BACKGROUND OF THE INVENTION

This invention relates generally to a tray for holding contaminated adsorbent materials for desorption thereof and more particularly concerns a ventilated tray which is particularly useful in microwave desorption.

In industry, process streams carrying contaminants or other components are often purified by passing the stream in contact with an adsorbent. The contaminants or other components are adsorbed by the adsorbent, thereby removing them from the process stream. Materials commonly used as adsorbents include activated carbon, activated charcoal, zinc oxide, activated alumina and molecular sieves. Adsorption is most effective when the adsorbent is maintained at ambient temperatures or cooler. The adsorbed materials are referred to as adsorbates or simply sorbates. Thus, a sorbated adsorbent refers to an adsorbent having adsorbed materials therein. In the course of cleansing process streams, the adsorbent will eventually become saturated with sorbates and be unable to adsorb further materials. Rather than simply being disposed of, a saturated adsorbent can be recycled through a process which desorbs or strips the sorbates from the adsorbent. Once the sorbates have been desorbed, the adsorbent is again capable of being used to cleanse process streams.

Many organic contaminants can be desorbed by heating the adsorbent to relatively low temperatures (e.g., in the range of 100°–300° C. for activated carbon). This low temperature process is referred to as regeneration. However, some contaminants cannot be desorbed at regeneration temperatures. These remnant contaminants, which might be high boiling point materials or result from polymerization on the adsorbent, are referred to as the "heel." After many (hundreds or even thousands) regenerations, the heel buildup diminishes the sorbent capacity of the adsorbent to the extent that the adsorbent is no longer useful. At this point, the adsorbent must not only be treated at higher temperatures (e.g., about 900°–1000° C. for activated carbon) but must also be exposed to reactants (such as steam or carbon dioxide) which can gasify some of the heel and the adsorbent to create new surface area. This process is called reactivation and is usually performed in large, off site furnaces. As used herein, the terms "desorption" or "desorbing process" refer to both regeneration and reactivation.

Traditionally, a saturated adsorbent is regenerated by heating the adsorbent with a flow of hot gas such as steam, nitrogen or flue gases to a sufficiently high temperature at which the sorbate is desorbed. The high temperature causes the sorbated matter to vaporize and pass from the adsorbent. The flow of the hot gas also purges the vaporized or desorbed materials from the system. Some disadvantages of this method include long regeneration times, use of large amounts of purge gas, and non-uniform heating of the adsorbent material. The gas heating method also requires heating not only the adsorbent material but also the entire structure containing the adsorbent, which is necessarily several times heavier than the adsorbent. Thus, the design of the containment structure is controlled by the temperature and corrosion limits prescribed by the regeneration process. In addition, this type of gas heating usually can achieve temperatures only in the range of about 100°–150° C. and is thus insufficient for reactivation.

Traditional reactivation processes are conducted in rotary kilns or Herreschoff multi-hearth furnaces in which the adsorbent is heated to the high reactivation temperatures while being exposed to the gasification reactants in continuous counter flows. The incidental stirring and tumbling motion of the adsorbent in such kilns or furnaces assures thorough contact of the adsorbent with the gasification reactants, thus providing complete reactivation. However, the stirring and tumbling tends to cause a high degree of relative movement between individual granules of the adsorbent. This relative movement tends to grind some of the adsorbent into smaller, less useful particles, thus producing costly attrition losses.

Another desorption approach is to use microwave energy to heat the adsorbent material. Microwave heating is quick and uniform and can produce relatively high temperatures so as to be applicable to both regeneration and reactivation. Microwave heating has a further advantage in that the adsorbent material can be heated without directly heating the containment structure. Thus, the energy required for microwave heating is less than heating with hot gas. The cost of the containment structure can also be reduced-since the structure itself is subjected to lower temperature ranges.

A simple approach to microwave desorption is to transfer the adsorbent from the adsorber vessel to a bulk container and expose the container to microwave energy in order to heat the adsorbent to the desorption temperature. The adsorbent is thus heated while at rest and without the stirring and tumbling motions described above. The lack of agitation minimizes attrition of the adsorbent. However, the lack of adsorbent agitation during reactivation severely limits contact between the adsorbent and the gasification reactants, thereby hampering the reactions. Furthermore, complete removal of desorbed materials from a stationary bed is difficult without a flow of purge gas through the bed. Thus, the capability to force gas flow through a stationary adsorbent bed, for the removal of desorption products and to induce successful gasification reactions, is crucial for the effective desorption of the bed.

Accordingly, there is a need for a container that supports a bed of adsorbent material for desorption while permitting thorough gas flow through the adsorbent bed without agitation thereof.

SUMMARY OF THE INVENTION

The above-mentioned need is met by the present invention which provides a ventilated tray for facilitating the desired gas flow. The ventilated tray comprises a housing having four walls and a bottom piece and a gas-permeable adsorbent support structure disposed in the housing. The adsorbent support structure is positioned above the bottom piece so that the adsorbent support structure, the bottom piece and the four walls define a plenum. A gas passage for providing fluid communication between the plenum and the exterior of the housing is provided. This passage is preferably in the form of an aperture located in one of the four .walls of the housing. An access aperture is also located in one of the walls for providing access to cleanout the plenum.

The plenum may be optionally filled with pelletized material to provide additional support.

The adsorbent support structure preferably comprises a porous plate having pores which are smaller than the grain size of the adsorbent material. Alternatively, the adsorbent support structure can comprise a plate having a plurality of holes formed therein and a plurality of circular members having larger diameters than the holes, wherein each one of the circular members is centered above one of the holes. Conversely, the circular plates can be centered below the holes. In another alternative, the adsorbent support structure comprises a first plate having a plurality of holes formed therein and a second plate having a plurality of holes formed therein positioned above the first. The holes in the respective plates are arranged so as not to be in direct vertical alignment. In a third alternative, the adsorbent support structure comprises a first plurality of spaced, coplanar bars defining gaps therebetween and a second plurality of spaced, coplanar bars disposed below the first bars so that each one of the second bars is located below one of the gaps defined by the first bars.

In a second embodiment, the ventilated tray again comprises a housing having four walls and a bottom piece. But instead of providing a separate gas-permeable adsorbent support structure defining a plenum, the bottom piece is gas-permeable and functions as the adsorbent support structure. As before, the adsorbent-supporting bottom piece can be in the form of a porous plate or one of the other alternatives described above.

Other objects and advantages of the present invention will become apparent upon reading the following detailed description and the appended claims and upon reference to the accompanying drawings.

DESCRIPTION OF THE DRAWINGS

The subject matter which is regarded as the invention is particularly pointed out and distinctly claimed in the concluding portion of the specification. The invention, however, may be best understood by reference to the following description taken in conjunction with the accompanying drawing figures in which:

DETAILED DESCRIPTION OF THE INVENTION

Figure 1:
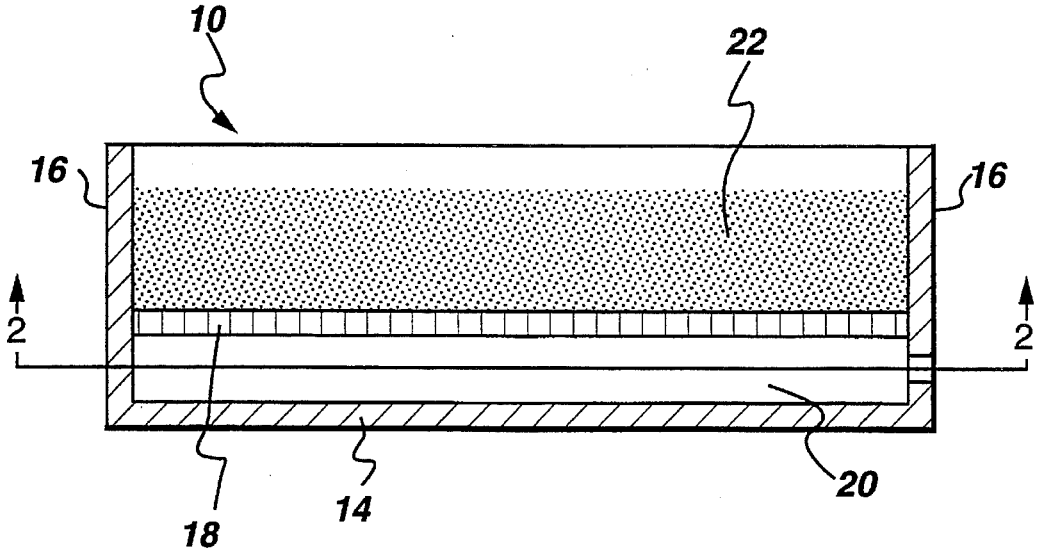
FIG. 1 shows a cross-sectional side view of a first embodiment of the adsorbent carrier tray of the present invention.
Figure 2:
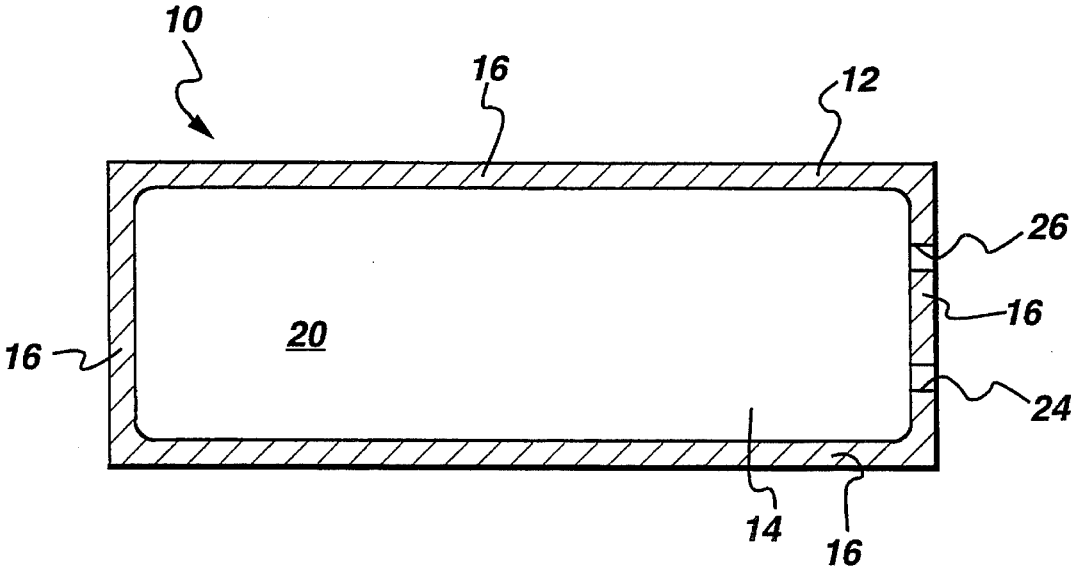
FIG. 2 shows a cross-sectional top view of the adsorbent carrier tray taken along line 2—2 of FIG. 1.

Referring to the drawings wherein identical reference numerals denote the same elements throughout the various views, FIGS. 1 and 2 show a first embodiment of the ventilated adsorbent carrier tray 10 of the present invention. The tray 10 comprises a tray housing 12 in the form of a box having an open top, a bottom piece 14 and four side walls 16. An adsorbent support plate 18 is situated in the housing 12, above the bottom piece 14 to define a gas plenum 20 in the lower portion of the housing 12. The housing 12 and the support plate 18 are both preferably made of a microwave transparent material such as ceramic. A bed of adsorbent 22 can be supported on the top of the support plate 18. The support plate 18 is a porous plate having pores which are smaller than the grain size of the adsorbent 22 so as to permit gas flow therethrough while not allowing the adsorbent 22 to fall through. The housing 12 has a gas passage aperture 24 formed therein. The gas passage aperture 24 is positioned below the support plate 18, thereby providing fluid communication between the plenum 20 and the exterior of the housing 12. While the gas passage aperture 24 is preferably formed in any one of the four walls 16 of the housing 12, it could also be formed in the bottom piece 14, as long as fluid communication with the plenum 20 is provided. Also, the gas passage need not necessarily be limited to a single aperture; a plurality of apertures could be used instead.

The adsorbent support plate 18 is primarily supported in the housing 12 by direct attachment to the side walls 16. However, since the load of adsorbent 22 can be quite heavy, supplemental plate support may be required. For instance, a number of microwave transparent support posts (not shown) could be disposed in the plenum 20 to extend between the bottom piece 14 and the support plate 18. In another option, the plenum 20 could be filled with a bed of pelletized material (not shown). The pelletized material is made of large pellets (or chunks or beads or the like) of microwave transparent material such as ceramic. The pellet size is sufficiently large so that gas can easily flow through the pelletized material. By filling the plenum 20, the pelletized material helps the support plate 18 in supporting the weight of the adsorbent 22.

A small portion of the adsorbent in the tray 10 may be reduced to small particles capable of sifting through the support plate 18 and into the plenum 20. Build up of this attrited adsorbent in the plenum 20 could reduce plenum volume can shield microwaves coming from under the tray 10. To provide a means for removing the adsorbent build up from the plenum 20, a cleanout aperture 26 (FIG. 2) is formed in one of the four walls 16 of the tray housing 12. Like the gas passage aperture 24, the cleanout aperture 26 is positioned below the support plate 18 so as to provide access to the plenum 20 from outside of the housing 12. Thus, removal of the adsorbent can be accomplished (if the optional pelletized material is not present in the plenum 20) by inserting an aspirating cleanout lance (not shown) through the cleanout aperture 26 and vacuuming the adsorbent. FIG. 2 also shows that the internal corners of the tray housing 12 are rounded to minimize local overheating of the adsorbent by the microwave energy.

In operation, sorbated adsorbent is loaded into the tray 10. The tray 10 is then placed in or conveyed through a heating cavity of a desorption apparatus. While the present invention is particularly useful with systems using microwave heating, it is not so limited and could be used in systems having other types of heating. The heating cavity, which does not constitute a part of the present invention, must have a duct positioned to engage the gas passage outlet 24 when the tray 10 is placed therein. Thus, gas flow in either direction between the interior of the heating cavity and the duct will pass through the adsorbent bed. One such heating cavity is described in the above-mentioned copending application Ser. No. 08/021,937.

Desorption can then be conducted with either an upflow or a downflow of gases through the adsorbent bed. For upflow, gaseous material is introduced into the plenum 20 via the duct and the gas passage aperture 24. These gases are distributed by the porous support plate 18 and permeate up through the bed of adsorbent 22 and into the heating cavity. For regeneration, the gaseous material is an inert purge gas such as nitrogen which sweeps the desorbed materials from the adsorbent 22. For reactivation, the gaseous material can include gasification agents such as steam, carbon dioxide or oxygen which produce the desired gasification reactions. An eduction fan connected to a vent in the heating cavity removes the desorption products from the cavity and creates the pressure difference necessary to create the upflow. In this upflow arrangement, the gas flow through the bed is kept sufficiently low so that there is little or no entrainment of the adsorbent 22.

In the downflow arrangement the direction of gas flow is simply reversed by drawing gas out of the duct connected to the gas passage aperture 24 (typically with an eduction fan) and introducing the gasification agents and/or purge gas into the heating cavity above the adsorbent bed 22. Thus, the gases first permeate down through the bed of adsorbent 22 and then pass through the porous support plate 18 into the plenum 20. The downflow arrangement has the advantages of keeping the heating cavity around the tray 10 clear of condensable sorbates and gasification products, thereby minimizing possible leakage of these gases into the local environment, and avoiding elution of adsorbent fines into the heating cavity.

Figure 3:
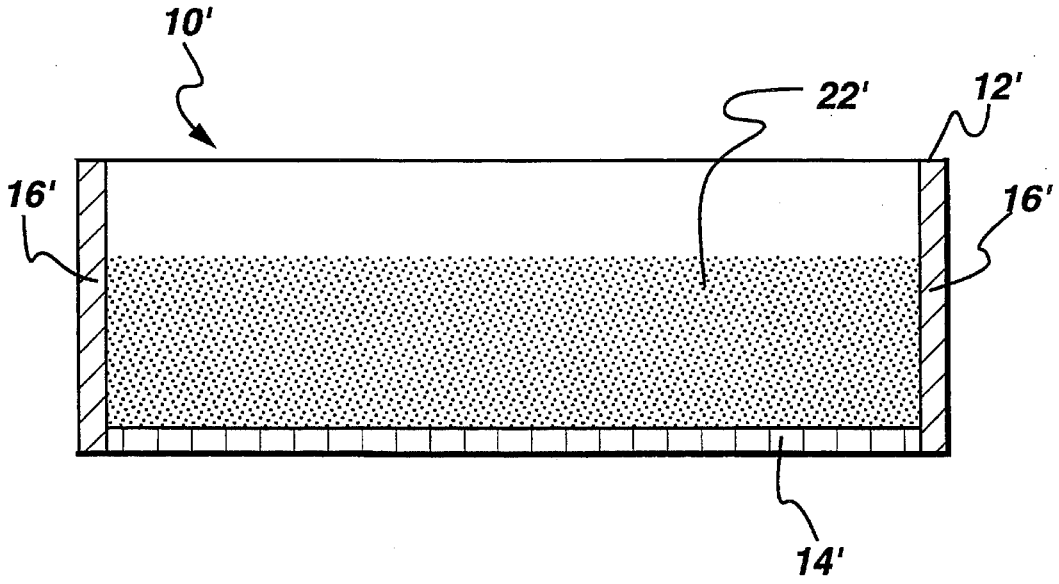
FIG. 3 shows a cross-sectional side view of a second embodiment of the adsorbent carrier tray of the present invention.

FIG. 3 shows a ventilated tray 10' which is a second embodiment of the present invention. Like the embodiment of FIGS. 1 and 2, the ventilated adsorbent carrier tray 10' of FIG. 3 comprises a tray housing 12' in the form of a box having an open top, a bottom piece 14' and four side walls 16'. The tray 10' differs from the previous embodiment in that there is no separate adsorbent support plate defining a gas plenum in the housing. Instead, the adsorbent 22' rests directly on the bottom piece 14'. The bottom piece 14' is a porous member having pores which are smaller than the grain size of the adsorbent 22' so as to permit gas flow therethrough while not allowing the adsorbent 22' to fall through, The operation of the second embodiment is similar to the first in that the ventilated tray 10' is loaded with sorbated adsorbent and placed in or conveyed through a heating cavity of a desorption apparatus. The heating cavity, which again does not form a part of the present invention, must have a means of supporting the tray 10' so that the porous bottom piece 14' is in fluid communication with a pressure chamber in the heating cavity. An example of such would be a porous conveyor belt which carries the tray 10' over the pressure chamber.

As before, desorption could be conducted by either an upflow or a downflow of gases through the adsorbent bed 22'. For an upflow process, gasification agents and/or purge gas are introduced into the pressure chamber. These gases are then distributed by the porous bottom piece 14' and permeate through the bed of adsorbent 22'. The gases coming off the top of the adsorbent bed 22' can then be drawn off through a vent in the heating cavity by a eduction fan. A downflow process is accomplished by introducing the gasification agents and/or purge gas into the heating cavity above the adsorbent bed 22' and drawing gas out of the pressure chamber with an eduction fan. Thus, gas from the cavity is drawn through the adsorbent bed 22' and the porous bottom piece 14' and then out through the pressure chamber.

Figure 4:
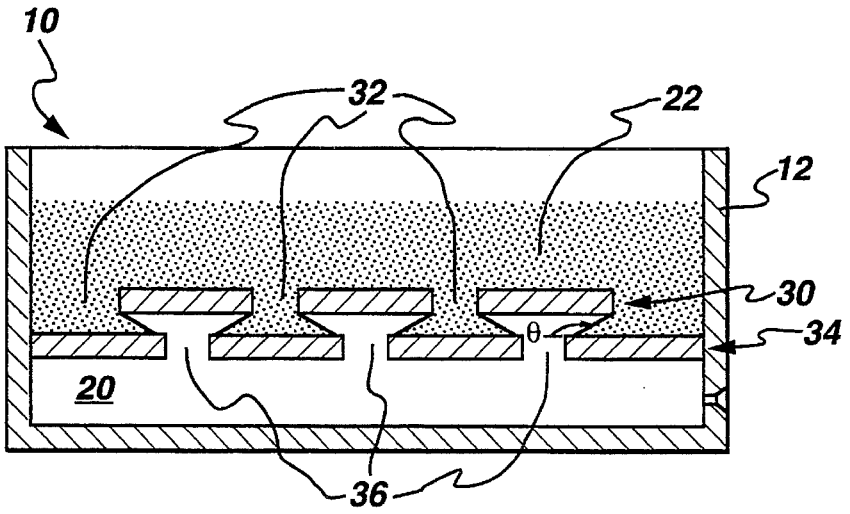
FIG. 4 shows a cross-sectional view of the adsorbent carrier tray of the present invention illustrating an alternative embodiment of the adsorbent support structure.

The present invention includes alternative adsorbent support structures which can be used instead of the support plate 18 or the porous bottom piece 14' described above. These alternatives use a two-tiered support structure which relies on the angle of repose of the adsorbent material to assist in supporting the adsorbent while still allowing gas flow therethrough. As used herein, the angle of repose, also known as the angle of rest, of a granular material is defined as the slope at which the granular material will come to a rest and stand without sliding when poured in a pile. FIG. 4 shows the two-tiered support structure as implemented in the batch-mode tray 10 of FIGS. 1 and 2. The two-tiered support structure is also applicable to the continuous mode tray 10' of FIG. 3. The two-tiered support structure comprises an upper support tier 30 with a plurality of relatively large openings 32 which is positioned directly above a lower support tier 34, having a plurality of large openings 36. The openings 32,36 of the respective tiers are not directly above one another but are instead staggered so that, as adsorbent falls through the openings 32 of the upper support tier 30 and onto the lower support tier 34, the angle of repose, θ, of the adsorbent material prevents the adsorbent from falling through the openings 36 of the lower support tier 34.

Figure 5:
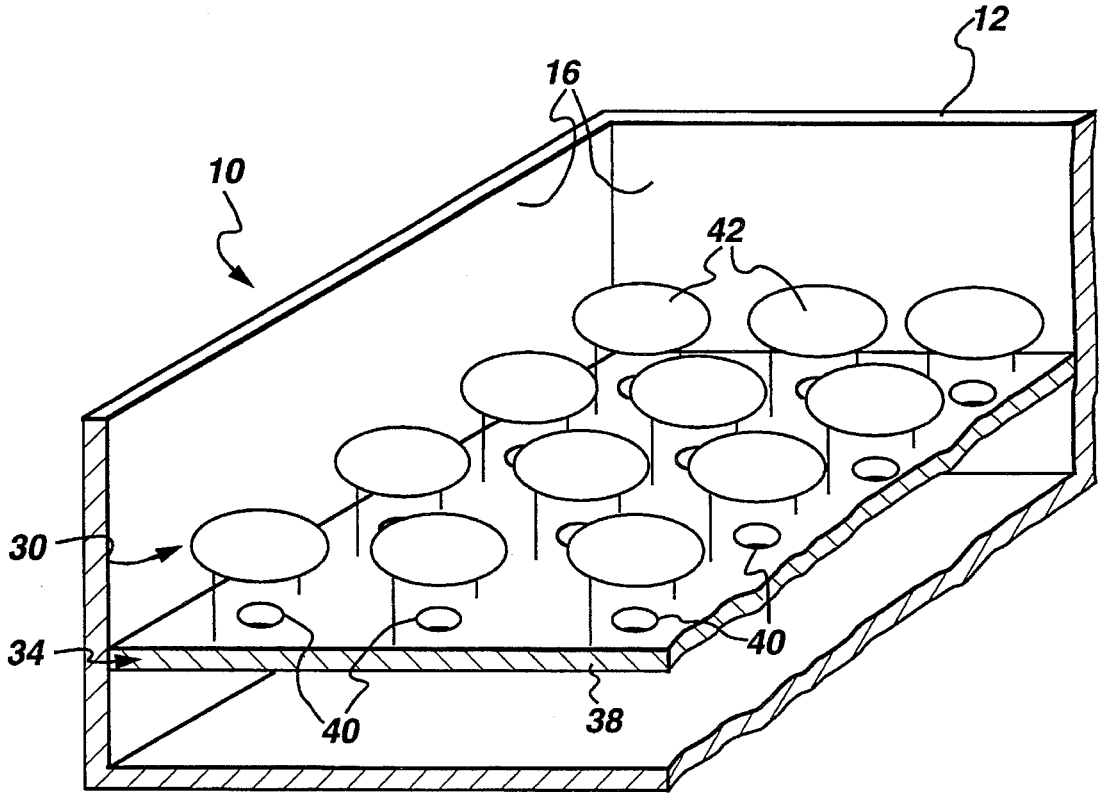
FIG. 5 shows a partially cut away perspective view of a first configuration of the adsorbent support structure of FIG. 4.

One configuration for a two-tiered support structure is shown in FIG. 5 wherein the lower support tier 34 is embodied by a support plate 38 having a plurality of large holes 40. The upper support tier 30 is embodied by a plurality of circular plates 42 supported above the support plate 38 and centered over the respective holes 40. The diameters of the circular plates 42 must be sufficiently greater than the diameters of the holes 40 so that the angle of repose would prevent adsorbent spilling over the edges of the circular plates 42 from falling through the holes 40. For instance, if the adsorbent material is activated carbon, then holes 40 having approximately one inch diameters on three inch centers and circular plates 42 having diameters 2–3 times that of the holes 40 disposed about 0.5–1 hole diameters above the support plate 38 would be sufficient to support the carbon without fall-through. Conversely, the circular plates 42 could be supported below the support plate 38.

Figure 6:
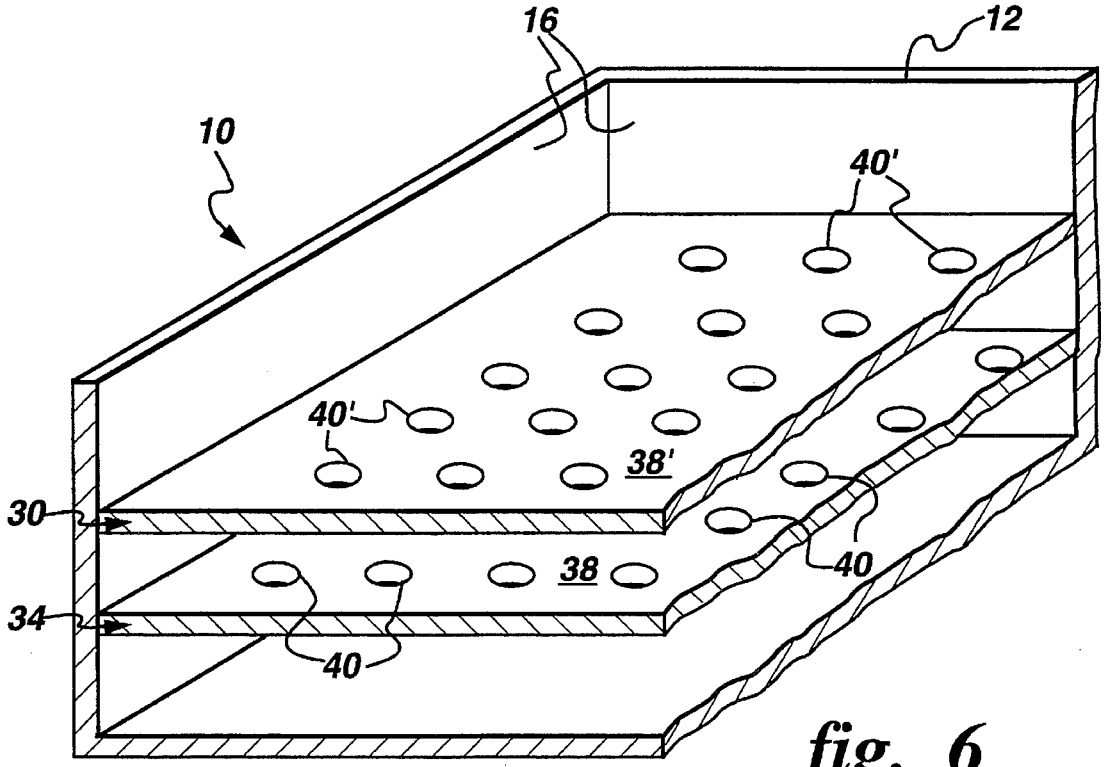
FIG. 6 shows a partially cut away perspective view of a second configuration of the adsorbent support structure of FIG. 4.

FIG. 6 shows a variation to the two-tiered support structure of FIG. 5. In this configuration the lower support tier 34 is again embodied by a support plate 38 having a plurality of large holes 40. However, the upper support tier 30 is embodied by a second support plate 38' having a plurality of large holes 40' disposed above the first plate 38 instead of circular plates. The holes 40,40' are arranged on the respective plates 38,38' so as not to be in vertical alignment and are spaced sufficiently so that the angle of repose would prevent adsorbent falling through the holes 40' of the upper plate 38' from falling through the holes 40 of the lower plate 38.

Figure 7:
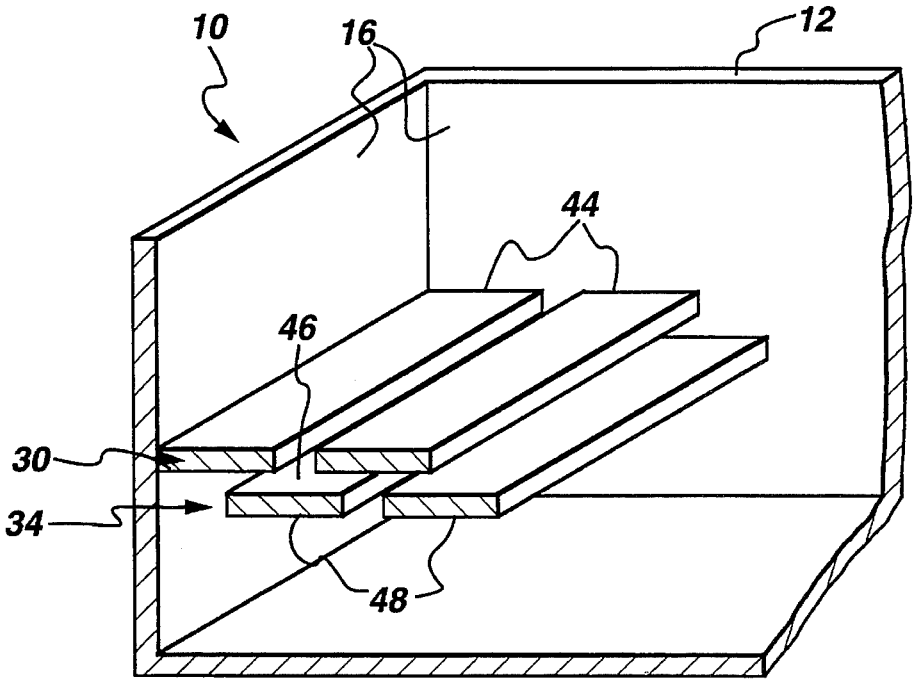
FIG. 7 shows a partially cut away perspective view of a third configuration of the adsorbent support structure of FIG. 4.

FIG. 7 shows a third configuration using the angle of repose concept. In this configuration, the upper support tier 30 is a first series of wide, flat bars or slats 44 spanning the width of the tray 10 with moderate gaps 46 (about three particle diameters) between each bar 44. The lower support tier 34 is a second series of similarly spaced wide bars or slats 48 located under the gaps 46 of the first series of bars 44. The edges of the respective series of bars would be staggered to create a sufficient overlap so that the angle of repose of the material would prevent adsorbent from falling through the lower tier 34. The side edges of the lower bars 48 could be slightly upturned to assist in holding the adsorbent.

The foregoing has described a ventilated tray in which gasification agents and/or purge gas can be optimally passed through a bed of adsorbent without agitation of the adsorbent. The through-flow of these gases provides effective removal of desorption products and, in for reactivation, assures complete gasification reactions. The ventilated tray is applicable to both continuous and batch processes.

While specific embodiments of the present invention have been described, it will be apparent to those skilled in the art that various modifications thereto can be made without departing from the spirit and scope of the invention as defined in the appended claims.

What is claimed is:

1. An adsorbent carrier tray for holding adsorbent during a desorption process, said adsorbent carrier tray comprising:

a housing having four walls, a bottom piece and an open top, said housing being made of a microwave transparent material and having a gas passage formed therein;

a gas-permeable adsorbent support structure attached to said housing, said adsorbent support structure being spaced above said bottom piece; and said adsorbent support structure comprising a plate having a plurality of holes formed therein and a plurality of circular members having larger diameters than said holes, each of said plurality of circular members being centered above one of said plurality of holes.

2. An adsorbent carrier tray for holding adsorbent during a desorption process, said adsorbent carrier tray comprising:

a housing having four walls, a bottom piece and an open top, said housing being made of a microwave transparent material and having a gas passage formed therein;

a gas-permeable adsorbent support structure attached to said housing, said adsorbent support structure being spaced above said bottom piece; and said adsorbent support structure comprising a plate having a plurality of holes formed therein and a plurality of circular members having larger diameters than said holes, each of said plurality of circular members being centered below one of said plurality of holes.

3. An adsorbent carrier tray for holding adsorbent during a desorption process, said adsorbent carrier tray comprising:

a housing having four walls, a bottom piece and an open top, said housing being made of a microwave transparent material and having a gas passage formed therein;

a gas-permeable adsorbent support structure attached to said housing, said adsorbent support structure being spaced above said bottom piece; and said adsorbent support structure comprising a first plate having a plurality of holes formed therein and a second plate having a plurality of holes formed therein disposed above said first plate, each of said plurality of holes on said first plate being arranged so as not to be in vertical alignment with each of said plurality of holes on said second plate.

4. An adsorbent carrier tray for holding adsorbent during a desorption process, said adsorbent carrier tray comprising:

a housing having four walls, a bottom piece and an open top, said housing being made of a microwave transparent material and having a gas passage formed therein;

a gas-permeable adsorbent support structure attached to said housing, said adsorbent support structure being spaced above said bottom piece; and said adsorbent support structure comprising a first plurality of spaced, coplanar bars defining gaps therebetween and a second plurality of spaced, coplanar bars disposed below said first plurality, each of said second plurality of bars being located below one of said gaps defined by said first plurality of bars.

5. An adsorbent carrier tray for holding adsorbent during a desorption process, said adsorbent carrier tray comprising:

a housing having four walls, a bottom piece and an open top, said housing being made of a microwave transparent material;

a gas-permeable adsorbent support structure disposed in said housing above said bottom piece, said adsorbent support structure, said bottom piece and said four walls defining a plenum;

a gas passage formed in said housing to provide fluid communication between said plenum and the exterior of said housing; and said adsorbent support structure comprising a plate having a plurality of holes formed therein and a plurality of circular members having larger diameters than said holes, each of said plurality of circular members being centered above one of said plurality of holes.

6. An adsorbent carrier tray for holding adsorbent during a desorption process, said adsorbent carrier tray comprising:

a housing having four walls, a bottom piece and an open top, said housing being made of a microwave transparent material;

a gas-permeable adsorbent support structure disposed in said housing above said bottom piece, said adsorbent support structure, said bottom piece and said four walls defining a plenum;

a gas passage formed in said housing to provide fluid communication between said plenum and the exterior of said housing; and said adsorbent support structure comprising a plate having a plurality of holes formed therein and a plurality of circular members having larger diameters than said holes, each of said plurality of circular members being centered below one of said plurality of holes.

7. An adsorbent carrier tray for holding adsorbent during a desorption process, said adsorbent carrier tray comprising:

a housing having four walls, a bottom piece and an open top, said housing being made of a microwave transparent material;

a gas-permeable adsorbent support structure disposed in said housing above said bottom piece, said adsorbent support structure, said bottom piece and said four walls defining a plenum;

a gas passage formed in said housing to provide fluid communication between said plenum and the exterior of said housing; and said adsorbent support structure comprising a first plate having a plurality of holes formed therein and a second plate having a plurality of holes formed therein disposed above said first plate, each of said plurality of holes on said first plate being arranged so as not to be in vertical alignment with each of said plurality of holes on said second plate.

8. An adsorbent carrier tray for holding adsorbent during a desorption process, said adsorbent carrier tray comprising:

a housing having four walls, a bottom piece and an open top, said housing being made of a microwave transparent material;

a gas-permeable adsorbent support structure disposed in said housing above said bottom piece, said adsorbent support structure, said bottom piece and said four walls defining a plenum;

a gas passage formed in said housing to provide fluid communication between said plenum and the exterior of said housing; and said adsorbent support structure comprising a first plurality of spaced, coplanar bars defining gaps therebetween sand a second plurality of spaced, coplanar bars disposed below said first plurality, each one of said second plurality of bars being located below one of said gaps defined by said first plurality of bars.

* * * * *